US008490525B2

(12) United States Patent
Wilson et al.

(10) Patent No.: US 8,490,525 B2
(45) **Date of Patent: *Jul. 23, 2013**

(54) COAXIAL CONNECTOR TORQUE APPLICATION DEVICE

(75) Inventors: Brandon Wilson, Phoenix, AZ (US); Timothy L. Youtsey, Scottsdale, AZ (US); Wang C. Hui, Sanchong (CN)

(73) Assignee: PCT International, Inc., Mesa, AZ (US)

( * ) Notice: Subject to any disclaimer, the term of this patent is extended or adjusted under 35 U.S.C. 154(b) by 265 days.

This patent is subject to a terminal disclaimer.

(21) Appl. No.: 13/026,571

(22) Filed: Feb. 14, 2011

(65) Prior Publication Data

US 2011/0162492 A1 Jul. 7, 2011

Related U.S. Application Data

(63) Continuation-in-part of application No. 12/470,430, filed on May 21, 2009, now Pat. No. 8,065,940.

(51) Int. Cl.
*B25B 23/14* (2006.01)
*B25B 23/155* (2006.01)

(52) U.S. Cl.
USPC ..... 81/475; 81/467

(58) Field of Classification Search
USPC ..... 81/475, 467; 29/758
See application file for complete search history.

(56) References Cited

U.S. PATENT DOCUMENTS

| | | | | |
|---|---|---|---|---|
| 508,314 | A | | 11/1893 | Hill |
| 1,092,574 | A | | 4/1914 | Jannson |
| 1,164,073 | A | | 12/1915 | Cunningham |
| 1,328,087 | A | * | 1/1920 | Le Chot ..... 81/475 |
| 1,464,128 | A | | 8/1923 | Coes |
| 1,571,148 | A | | 1/1926 | Sisolak |
| RE16,354 | E | | 5/1926 | Carlberg |
| 1,613,976 | A | | 1/1927 | Bellows |
| 1,613,981 | A | | 1/1927 | Carlberg |
| 2,697,370 | A | * | 12/1954 | Brooks ..... 81/58 |
| 3,709,087 | A | * | 1/1973 | Stone, Jr. ..... 411/6 |
| 3,837,244 | A | | 9/1974 | Schera, Jr. |
| 4,215,600 | A | | 8/1980 | Kesselman |

(Continued)

FOREIGN PATENT DOCUMENTS

| | | |
|---|---|---|
| EP | 471977 | 2/1992 |
| WO | WO-2012112580 | 2/1992 |
| WO | WO03/056728 | 7/2003 |
| WO | WO-2010/135598 A1 | 11/2010 |

OTHER PUBLICATIONS

Non-Final Office Action; U.S. Appl. No. 12/470,430; Date of Mailing: May 26, 2011. 8 pages.

(Continued)

*Primary Examiner* — David B Thomas

(74) *Attorney, Agent, or Firm* — Perkins Coie LLP

(57) ABSTRACT

A torque application device according to aspects of the present invention comprises (1) a collar for engaging a fastener, (2) a grip coupled to the collar, the grip preferably configured to magnify torque applied to it and to transfer all or part of the magnified torque to the collar, and (3) a slip mechanism to help avoid applying more than a predetermined, maximum amount of torque. The device may further include an indicator (such as a visual, audible and/or tactile indicator) to indicate when a predetermined maximum torque has been reached.

31 Claims, 16 Drawing Sheets

U.S. PATENT DOCUMENTS 4,472,098 A 9/1984 Kiefer
4,505,171 A 3/1985 Chang
4,687,392 A * 8/1987 Bidwell ..... 411/6
4,964,319 A 10/1990 Chang
5,158,458 A * 10/1992 Perry ..... 433/141
5,176,050 A 1/1993 Sauer et al.
5,179,617 A 1/1993 Stockman
5,299,474 A 4/1994 Hohmann et al.
5,301,575 A 4/1994 Mehlau et al.
5,392,508 A 2/1995 Holliday et al.
5,415,065 A 5/1995 McMills
5,487,220 A 1/1996 Saitou
5,507,211 A 4/1996 Wagner
5,615,587 A 4/1997 Foerster, Jr.
5,743,131 A 4/1998 Holliday et al.
5,746,298 A * 5/1998 Krivec et al. ..... 192/48.3
5,797,300 A 8/1998 Fairbanks
5,934,137 A 8/1999 Tarpill
5,941,120 A 8/1999 Jee
5,950,509 A * 9/1999 Doong ..... 81/475
5,983,489 A 11/1999 Jee
6,186,785 B1 2/2001 Rogers et al.
6,196,045 B1 3/2001 Thomas et al.
6,252,170 B1 6/2001 Korinek
6,293,004 B1 9/2001 Holliday
6,309,154 B1 * 10/2001 Higgins ..... 411/7
6,349,625 B1 2/2002 Poganski
6,427,275 B1 8/2002 Hung
6,439,086 B1 8/2002 Bahr
6,499,358 B1 * 12/2002 Hogan et al. ..... 73/862.21
6,591,487 B2 7/2003 Chang
6,606,924 B2 8/2003 Chandler et al.
6,637,299 B1 10/2003 Steele
6,708,396 B2 3/2004 Holliday
6,802,680 B1 * 10/2004 Rubenstein ..... 411/7
6,817,272 B2 11/2004 Holland
6,832,533 B1 * 12/2004 Huang ..... 81/475
6,848,920 B2 2/2005 Fox
6,928,907 B2 8/2005 Casabonne et al.
7,011,001 B2 3/2006 Knox et al.
7,024,970 B2 4/2006 Boman
7,028,393 B2 4/2006 Wei
7,029,305 B2 4/2006 Weidner
7,032,481 B2 4/2006 Li et al.
7,080,581 B2 7/2006 Reese
7,096,573 B2 8/2006 Holliday
7,120,997 B2 10/2006 Islam et al.
7,152,309 B2 12/2006 Liao
7,159,494 B2 * 1/2007 Jamnia et al. ..... 81/467
7,222,559 B2 5/2007 Wang
7,249,540 B1 7/2007 Hacker et al.
7,281,458 B2 * 10/2007 Chuang ..... 81/475
7,299,543 B2 11/2007 Montena
7,299,725 B2 11/2007 Helstern et al.
7,347,129 B1 3/2008 Youtsey
7,544,086 B1 6/2009 Wells
7,798,849 B2 9/2010 Montena
7,837,501 B2 * 11/2010 Youtsey ..... 439/578
7,975,578 B2 7/2011 Youtsey
8,065,940 B2 * 11/2011 Wilson et al. ..... 81/475
2002/0174538 A1 11/2002 Chang
2002/0194726 A1 12/2002 Chang
2003/0051337 A1 3/2003 Holliday
2005/0020129 A1 1/2005 Dykstra
2005/0161246 A1 7/2005 Khemakhem et al.
2006/0021479 A1 2/2006 Reese
2006/0143904 A1 7/2006 Holliday
2006/0150784 A1 7/2006 Hsieh
2006/0179981 A1 8/2006 Cutler et al.
2006/0240709 A1 10/2006 Montena
2007/0039426 A1 2/2007 Chuang
2007/0251085 A1 11/2007 Holliday et al.
2008/0087145 A1 4/2008 Youtsey
2008/0304907 A1 * 12/2008 Figge et al. ..... 403/408.1
2009/0049962 A1 2/2009 Cutler
2009/0133980 A1 5/2009 Swaim et al.
2010/0018040 A1 1/2010 Bradley
2010/0022120 A1 1/2010 Bradley
2010/0294094 A1 11/2010 Wilson et al.
2010/0307299 A1 12/2010 Nino et al.
2010/0313412 A1 12/2010 Youtsey et al.
2011/0056341 A1 * 3/2011 Lai ..... 81/475

OTHER PUBLICATIONS

Cable Pro, TechToolSupply.com, http://www.techtoolsupply.com/index.asp?PageAction=VIEWPROD&ProdID=223, 2 of 5 pages printed from the Internet on Jun. 8, 2008.

Non-Final Office Action; U.S. Appl. No. 12/470,430; Date of Mailing: Sep. 3, 2010, Applicant: PCT International.

International Search Report and Written Opinion, PCT/US10/35679, Mailed on Sep. 1, 2010, Applicant: PCT International, Inc., 13 pages.

International Search Report and Written Opinion mailed May 25, 2012; International Application No. PCT/US2012/025090; Applicant: PCT International, Inc.; 10 pages.

* cited by examiner

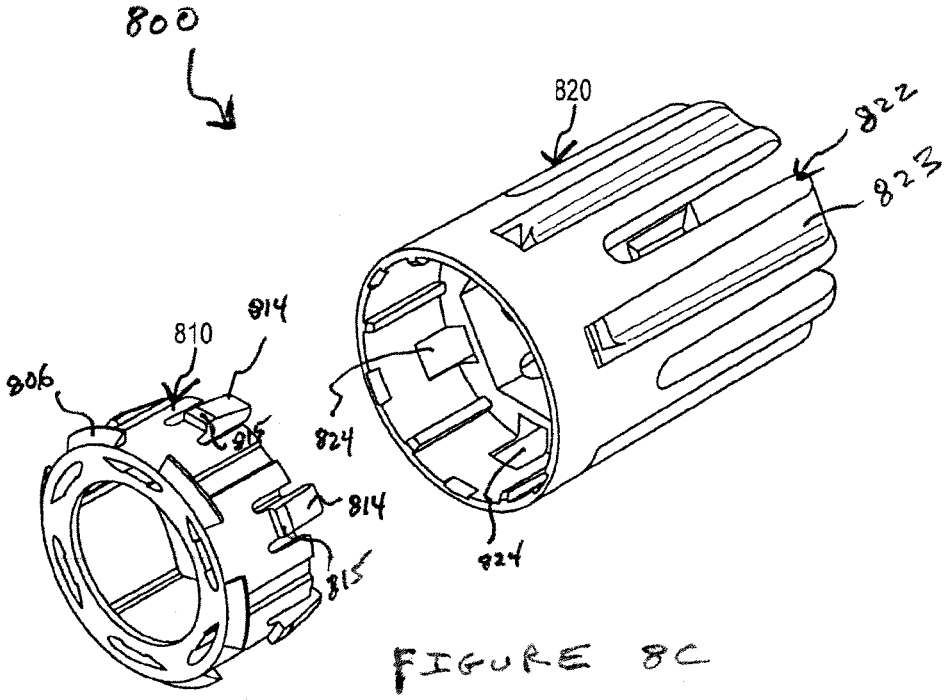
FIGURE 8C
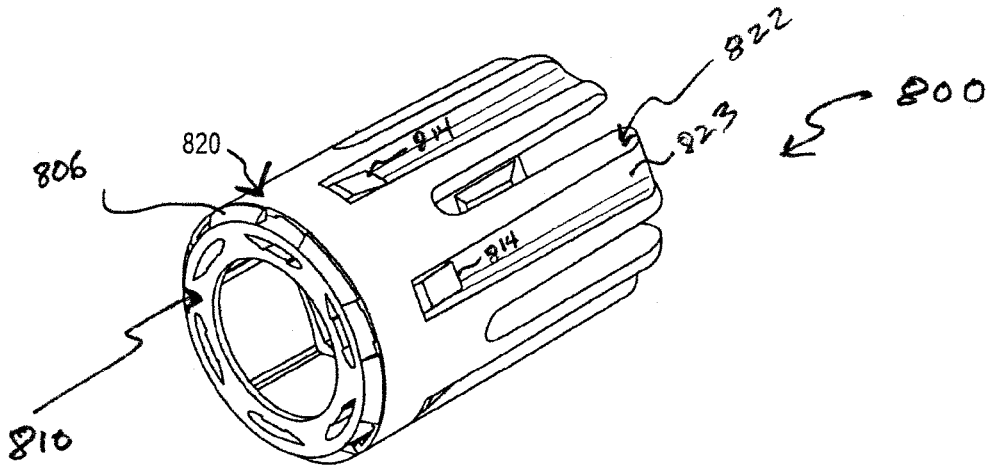
FIGURE 8C- I

COAXIAL CONNECTOR TORQUE APPLICATION DEVICE

CROSS-REFERENCE TO RELATED APPLICATION(S)

This application is a continuation-in-part of, and claims priority under 35 U.S.C. §§119 and 120 to, U.S. patent application Ser. No. 12/470,430, entitled "Torque Application Device," filed May 21, 2009 by Brandon Wilson and Timothy L. Youtsey, the disclosure of which is incorporated herein by reference in its entirety.

TECHNICAL FIELD

The present invention relates to torque application devices, and more particularly, to torque application devices for use with F-type coaxial cable connector fasteners or similar devices, wherein the device can apply the proper amount of torque and is not likely to over tighten the fastener.

BACKGROUND

In many applications, fasteners such as nuts, bolts, screws, clasps, and clamps require the application of sufficient torque to properly engage, but can also be over-tightened, potentially damaging the fastener and/or the structure to which the fastener is attached (this structure is sometimes referred to herein as an attachment structure). One such fastener is the fastener for a screw-on, F-type connector. F-type connectors (or "F-connectors") are used on most radio frequency (RF) coaxial cables to interconnect TVs, cable TV decoders, VCR/DVD's, hard disk digital recorders, satellite receivers, and other devices. Male F-type connectors (sometimes called the "male connector" or "male F-connector") have a standardized design, generally using a 7/16 inch hex nut as a fastener. The nut has a relatively short (e.g., 1/8 to 1/4 inch) length and can be grasped by a person's fingers to be tightened or loosened.

In order to maintain a tight electrical connection, and to achieve the intended electrical performance, manufacturers and industry standards often require an F-type connector to be tightened to an attachment structure (with respect to F-F-type connector to be tightened to an attachment structure (with respect to F-connectors, these attachment structures are sometimes called the "female connector" or "female F-connector") beyond the torque achievable by using only a person's fingers. In the case of cable TV products, for example, the standard has been to tighten the fastener using a 25 in-lb torque (or to tighten another 90-120 degrees from the finger-tight position). Conversely, consumer products, which have weaker attachment structures (such as plastic), require F-type connector fasteners to be wrench-tightened just slightly beyond finger tight.

A person tightening a fastener by hand may only be able to apply 4-5 ft-lbs of torque to an F-connector fastener using his/her fingers, whereas 10-25 ft-lbs of torque may be required to properly secure an F-connector fastener to an attachment structure. If a person were, however, to use a wrench to tighten the fastener, in addition to the wrench being bulky and inconvenient, the person runs the risk of over-tightening the fastener and potentially damaging the attachment structure. Applying too little or too much torque can thus result in suboptimal performance, increases in returns to the manufacturer, customer service calls, and complaints from consumers.

Therefore, it is desirable to tighten many fasteners by hand and be able to apply sufficient torque to tighten the fastener without over-tightening the fastener. Further, different products may require differing amounts of torque to adequately tighten F-type connectors to achieve optimal performance and it would also be an advantage to supply a kit of different devices to be used, respectively, with different fasteners.

SUMMARY

The present invention allows for a fastener to be tightened to a predetermined level of torque, and greatly reduces the likelihood that a user could over-tighten the fastener beyond that amount.

A torque application device according to the present invention comprises (1) a collar for engaging a fastener, (2) a grip coupled to the collar, wherein the grip is preferably configured to increase the amount of torque applied to the collar, such that a predetermined maximum torque can be applied via the grip to the collar to tighten the fastener, and (3) a slip mechanism that partially or totally decouples the collar and grip if a user attempts to apply more than the predetermined maximum torque. Preferably, a passage is defined by the device to allow a wire or cable (to which the fastener is preferably attached) to pass through the device. The device may further include an indicator(s) (such as a visual, tactile, and/or audible indicator(s)) to indicate that the predetermined maximum torque has been reached.

In another embodiment, a torque application device according the present invention comprises (1) a collar for engaging a fastener, (2) a grip coupled to the collar, the grip configured transfer torque to the collar, and (3) a slip mechanism. The slip mechanism comprises a plurality of protrusions extending from either the collar or the grip and a plurality of retaining structures, which are formed in the grip if the protrusions extend from the collar and are formed in the collar if the protrusions extend from the grip. Each retaining structure is configured to engage a protrusion when a torque less than or equal to a predetermined maximum amount of torque is applied to the collar. When the torque exceeds the predetermined maximum amount, the protrusions disengage from the retaining structures to partially or totally decouple the grip from the collar.

The torque application device can be attached to fasteners after or before the fastener is attached to a cable, or the device can be positioned on a cable to be attached to a fastener prior to the cable being, or after the cable is, attached to the fastener. Alternately, the device of the present invention could be permanently affixed to a fastener and could possibly be integrally formed with the fastener.

Both the foregoing summary and the following detailed description are exemplary only and are not restrictive of the invention.

BRIEF DESCRIPTION OF THE DRAWINGS

FIG. 8A-1 is a reverse, perspective view of the collar of FIG. 8A.

FIG. 8A-2 is a top view of the collar of FIG. 8A.

FIG. 8A-3 is a bottom view of the collar of FIG. 8A.

FIG. 8A-4 is a partial, enlarged view of the collar as shown in FIG. 8A-3.

FIG. 8B-1 is an alternate perspective, side view of the grip of FIG. 8B.

FIG. 8B-2 is a top view of the grip of FIG. 8B showing the opening that receives a collar.

FIG. 8B-3 is a side view of the grip of FIG. 8B.

FIG. 8B-4 is a bottom view of the grip of FIG. 8B.

FIG. 8B-5 is a cross-sectional side view of the grip of FIG. 8B.

FIG. 8C is a perspective view of a torque application device utilizing the collar of FIGS. 8A-8A-4 and the grips of FIGS. 8B-8B-5 before the collar and grip are connected.

FIG. 8C-1 is a perspective view of the torque application device of FIG. 8C after the collar 810 and grip 820 have been connected.

FIG. 8D-1 is a top view of the torque device of FIG. 8C.

FIG. 8D-2 is a side view of the torque device of FIG. 8C.

DETAILED DESCRIPTION

Figure 1A:
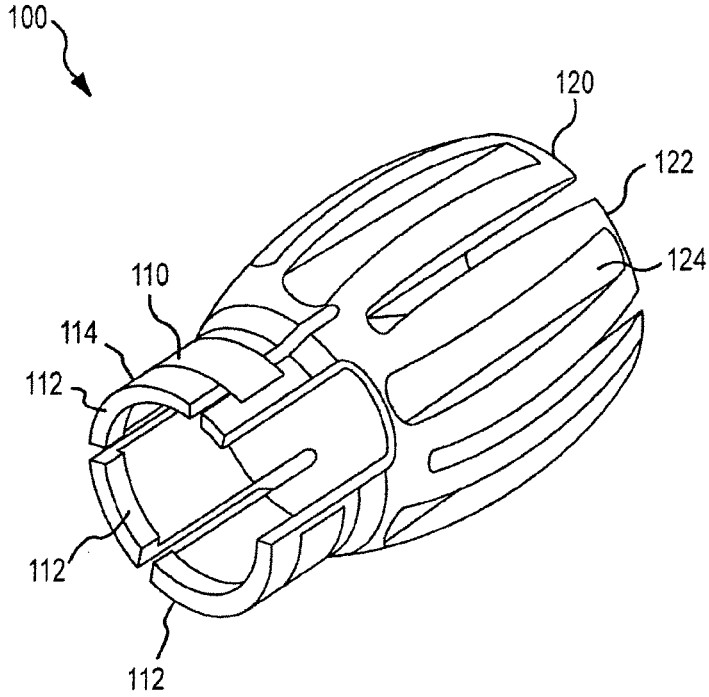
FIG. 1A depicts an exemplary torque application device according to aspects of the present invention.

A preferred (or exemplary) torque application device 100 according to aspects of the present invention is depicted in FIGS. 1A, 2, 4A and 4B. Device 100 includes a collar 110, a grip 120, and a slip mechanism 415. The device 100 allows a user to use his/her hand, fingers or a tool to apply a predetermined maximum torque to a fastener, such as an F-type coaxial cable connector fastener 210 (shown here as a hexagonal nut), so that the fastener is fully tightened, but not over-tightened.

The collar 110 is configured to engage one or more fasteners and can be of any suitable structure or material suitable for use with a particular fastener and fastening application. The collar 110 can be configured to engage any suitable size and type of fastener(s), such as a nut, bolt, screw, clasp, and/or clamp. In the exemplary embodiment depicted in FIGS. 1A and 2, the collar 110 is made of plastic, such as polyethylene or any suitable plastic, and includes a plurality of longitudinally-extending portions 112 that engage the hexagonal nut fastener 210 of a F-type connector. A fastening ring 114 assists sections 112 in gripping the fastener 210. Sections 112 may have raised segments 112A each having an inner wall 112B. In this embodiment, when collar 110 is positioned on a fastener such as fastener 210, the fastener 210 is retained in collar 110 behind inner walls 112B. In this manner, device 100 can remain attached to the fastener for later use to either loosen or tighten the fastener 210.

Figure 1B:
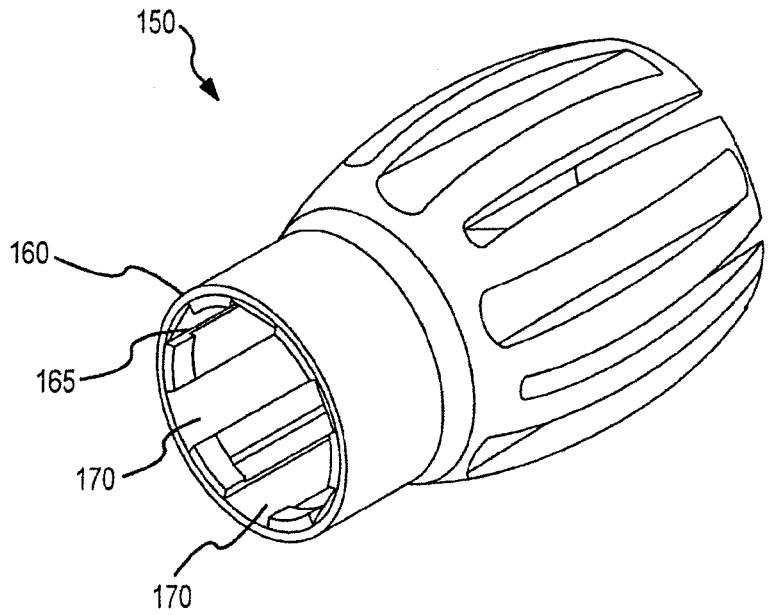
FIG. 1B depicts another exemplary torque application device according to aspects of the present invention.

In another exemplary embodiment of the present invention, referring now to FIG. 1B, device 150 includes a collar 160 that comprises an inner portion 165 with flat portions 170 arranged about the longitudinal axis of the device 150 for engaging an F-type connector. In this embodiment, the collar 160 is configured to fit over, and snap onto, an F-type connector to allow a user to apply torque to the connector. The collar 160 can alternately be configured to engage any other suitable type of connector. As with collar 110, collar 160 may be formed from any suitable materials. The collar 160 can interact with the grip 120 in the same manner described below for the collar 110.

The grip 120 is configured to receive torque from a person's hand (or fingers) such that torque can be applied, and the grip preferably uses mechanical advantage to generate a greater torque to be transferred to the collar to tighten the fastener. Once the maximum torque applied to the collar 110 has been reached, any further attempt to tighten the fastener decouples grip 120 from collar 110 via the slip mechanism (the preferred embodiment of which is described below) and no additional torque above the maximum torque is applied. This helps to ensure that the fastener engaged by the collar 110 is fully tightened, and prevents or greatly reduces the likelihood of the fastener being over-tightened.

The grip 120 can be configured to receive torque from any suitable source, may be formed from any suitable material(s), and may be of any suitable size, shape and configuration. In the exemplary embodiments depicted in FIGS. 1A, 1B, and 2, the grip 120 is comprised of plastic, such as polyethylene, is between about 17 mm and about 20 mm long, 13 mm in diameter (at its widest point), and is configured to receive torque applied by a human hand. In the exemplary embodiment, the grip 120 includes a plurality of struts 122 arranged about its central axis. In this embodiment, the struts 122 are non-rectilinear and each includes a groove 124 to help the fingers or hand grasp the grip 120. The grip 120 may be formed from semi-rigid plastic or other suitable material to allow a human hand or fingers to squeeze and twist the grip 120 and deliver torque to the device 100 without excessively deforming the grip 120.

Figure 2:
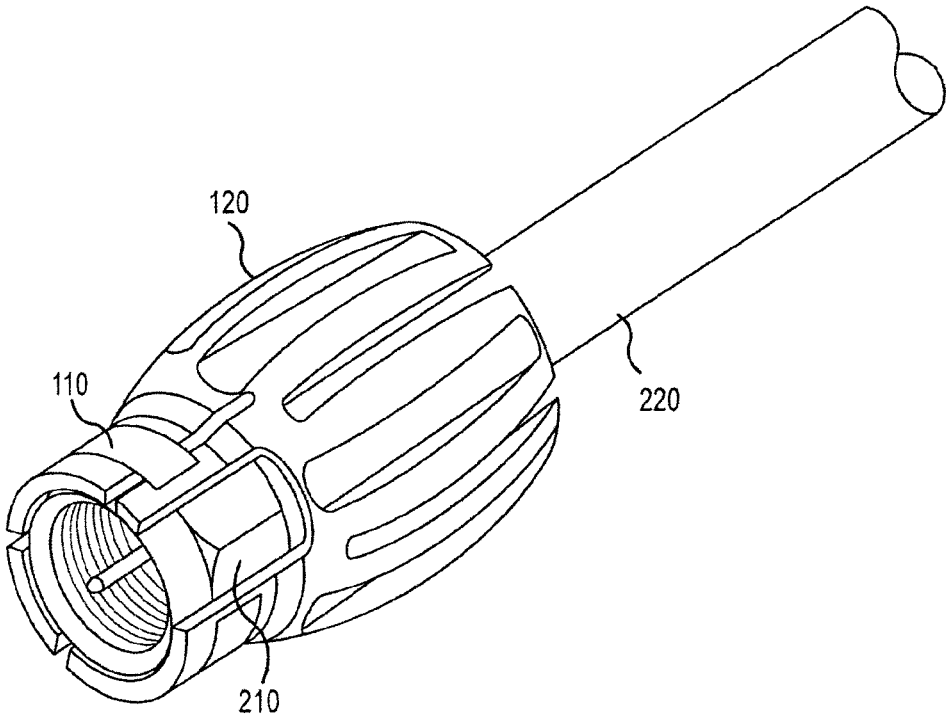
FIG. 2 depicts the device of FIG. 1A engaging an F-type connector fastener that is connected to a cable that extends through the device.

In the exemplary device, the collar 110 comprises an opening for receiving the fastener. The grip 120 also comprises an opening which is in communication with the opening in the collar. The openings in the collar 110 and the fastener 120 define a passage through the device 100. This passage allows for the cable 220, attached to the F-type connector fastener 210, to pass through the device, as shown in FIG. 2.

The grip 120 and the collar 110 are decoupled when at least the predetermined maximum torque is applied to the collar 110. In this context, the term "decoupled" means any disengagement, whether complete or partial, of the grip 120 and collar 110 that prevents the collar 110 from receiving torque beyond the predetermined maximum torque. As discussed with reference to FIGS. 4A and 4B, this decoupling may be accomplished by the use of a slip mechanism 415, which is the preferred embodiment and comprises protrusions 420 on a surface (the "first surface") of the grip 120 and protrusions 430 on a surface (the "second surface") of the collar 110. The protrusions 420 "traverse" (i.e., slip past or disengage from) the protrusions 430 if a user attempts to further tighten the fastener after the predetermined maximum torque has been applied to the collar 110.

Figure 4A:
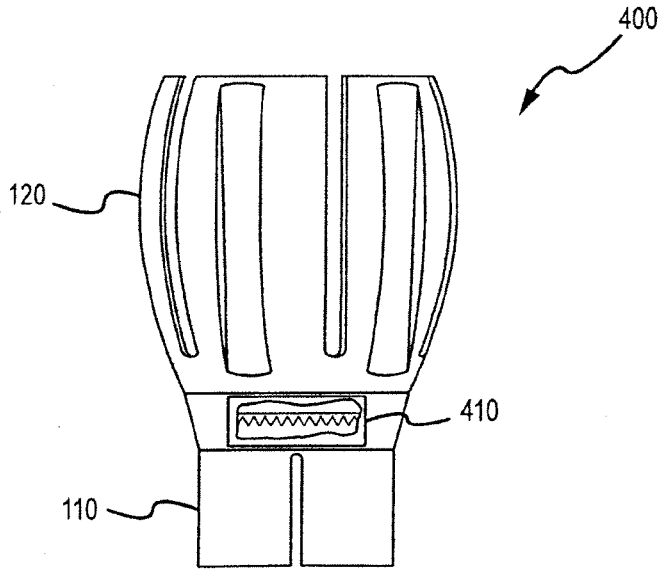
FIG. 4 depicts another exemplary torque application device according to various aspects of the present invention.
Figure 4B:
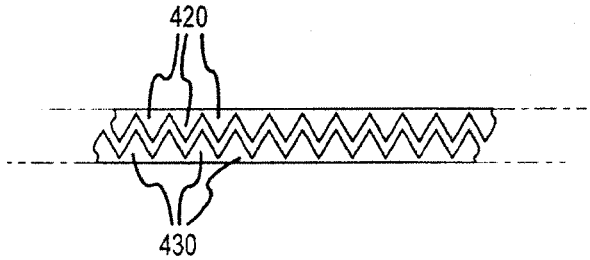

In the exemplary embodiment depicted in FIGS. 4A and 4B, the protrusions 420 and 430 have a triangular cross-section, however such protrusions can have any suitable size, shape, configuration, and spacing. If protrusions, such as protrusions 420, 430, are utilized as the slip mechanism, they can be appropriately designed to allow for differing maximum amounts of torque. Alternatively, different materials (potentially in conjunction with different shape configurations) may be used to allow for different maximum amounts of torque. This enables the present invention to be custom-configured to apply different maximum torques for different applications.

A device according to the invention may be removably or semi-permanently, or permanently, attached to a fastener. A device may be removably or semi-permanently attached to a fastener by positioning the device so that the collar 110 receives the fastener, such as a hexagonal nut 210, as depicted in FIG. 2. Cable 220 would extend through the passage defined in the device, and the device would be attached to the fastener prior to fully tightening the fastener to an attachment structure. In the embodiment shown in FIG. 2, the fastener 210 would be received and retained in the opening of the collar 110 behind the inner walls 112B. Device 100 may, however, not include sections 112A and collar 110 would simply be moved into position onto a fastener, such as fastener 210, when being used to loosen or tighten the fastener, and then be removed from the fastener but still retained on cable 220 for future use if required.

Alternately, the device 100 can be permanently affixed to the fastener or integrally formed with the fastener. In that case, the fastener would replace the collar 110 and the fastener would be directly coupled to the grip 120 with the slip mechanism formed on the grip and/or fastener.

Figure 3A:
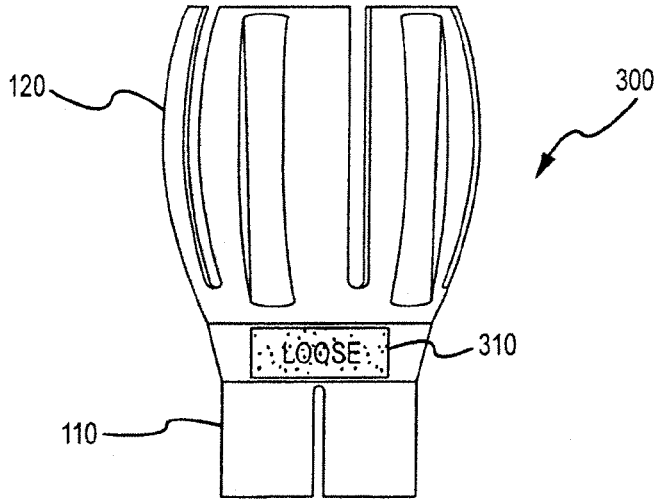
FIGS. 3A and 3B depict the device of FIG. 1A with visual indicators showing whether a predetermined maximum torque has been applied.
Figure 3B:
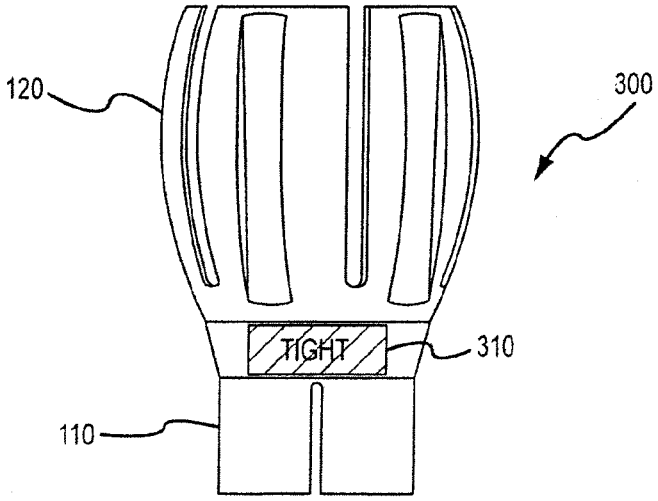

Another device according to the present invention is depicted in FIGS. 3A and 3B. In this exemplary embodiment, device 300 includes a visual indicator 310 to show when a predetermined maximum torque has been applied to the collar 110. In this embodiment, the visual indicator 310 comprises a first message ("LOOSE") and/or a first color (such as green) to indicate that the maximum torque has not been applied to the collar, and therefore the fastener is still not sufficiently tightened. Conversely, once the maximum torque has been applied to the collar 110 and the fastener is fully tightened, the first message is replaced by a second message ("TIGHT") and/or with a second color (such as red).

An audible indicator can be used with, or used instead of, visual indicator 310 to indicate that the predetermined maximum torque has been applied to the collar 110. Referring to FIGS. 4A and 4B, for example, the grip 120 and collar 110 of device 400 comprise protrusions 420 and 430, respectively. As shown in FIG. 4B, the protrusions 420 and 430 engage each other when less than the maximum amount of torque is applied to the collar 110. This allows torque to be applied to the collar 110 via the grip 120. Once a torque greater than the maximum amount of torque permitted by the slip mechanism is applied to the collar 110, protrusions 420 traverse protrusions 430, and may create an audible clicking sound that alerts a user applying force to the device 400 that the maximum amount of torque has been applied.

Finally, a tactile indicator could be used in addition to, or instead of, a visual indicator and/or audible indicator. Again, with respect to protrusions 420 and 430, a user will feel slippage when the maximum torque is reached.

Figure 5:
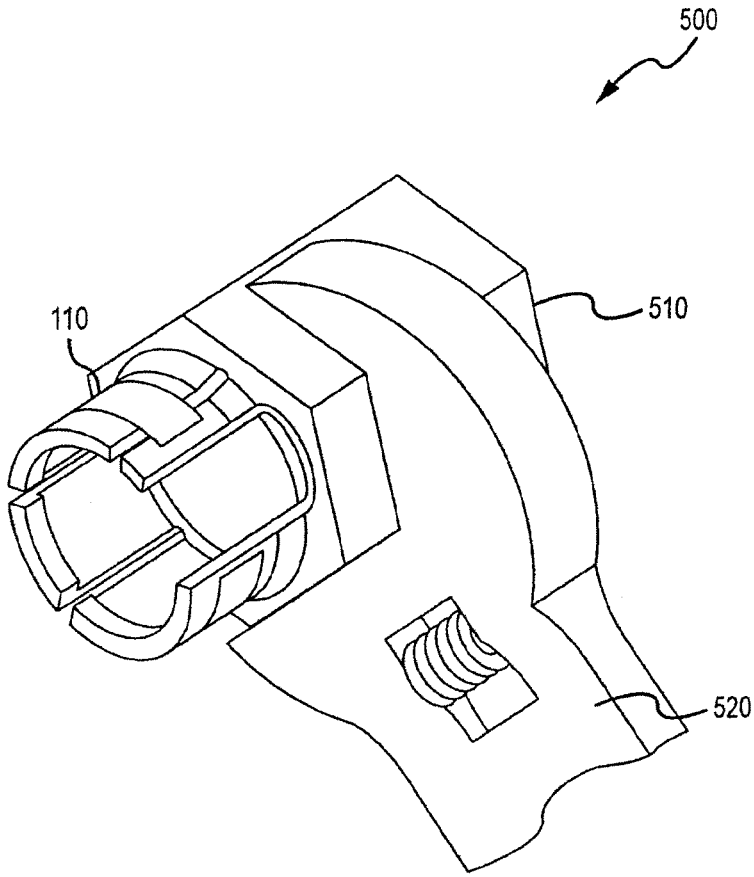
FIG. 5 depicts another exemplary torque application device according to various aspects of the present invention.

In another exemplary embodiment, referring now to FIG. 5, a device 500 includes a grip 510 that is configured to receive torque applied by a tool 520. In this exemplary embodiment, grip 510 includes a hexagonal exterior for engagement with tool 520, which as shown is a wrench.

The interior of grip 510 is hollow to allow the device 500 to slide over a cable 220 attached to an F-type connector fastener 210. Among other things, the grip 510 provides a larger hexagonal area for an installer to engage with a tool 520 than is available on the F-type connector 210 itself. As with other devices of the present invention, the device 500 will only allow the predetermined maximum torque to be applied to the collar when tightening the fastener, such that an installer is unlikely to over-tighten the fastener. The slip mechanism and collar are preferably of the same configuration as previously described for device 100. Device 500 may also include one or more of the previously-described indicators.

Figure 6A:
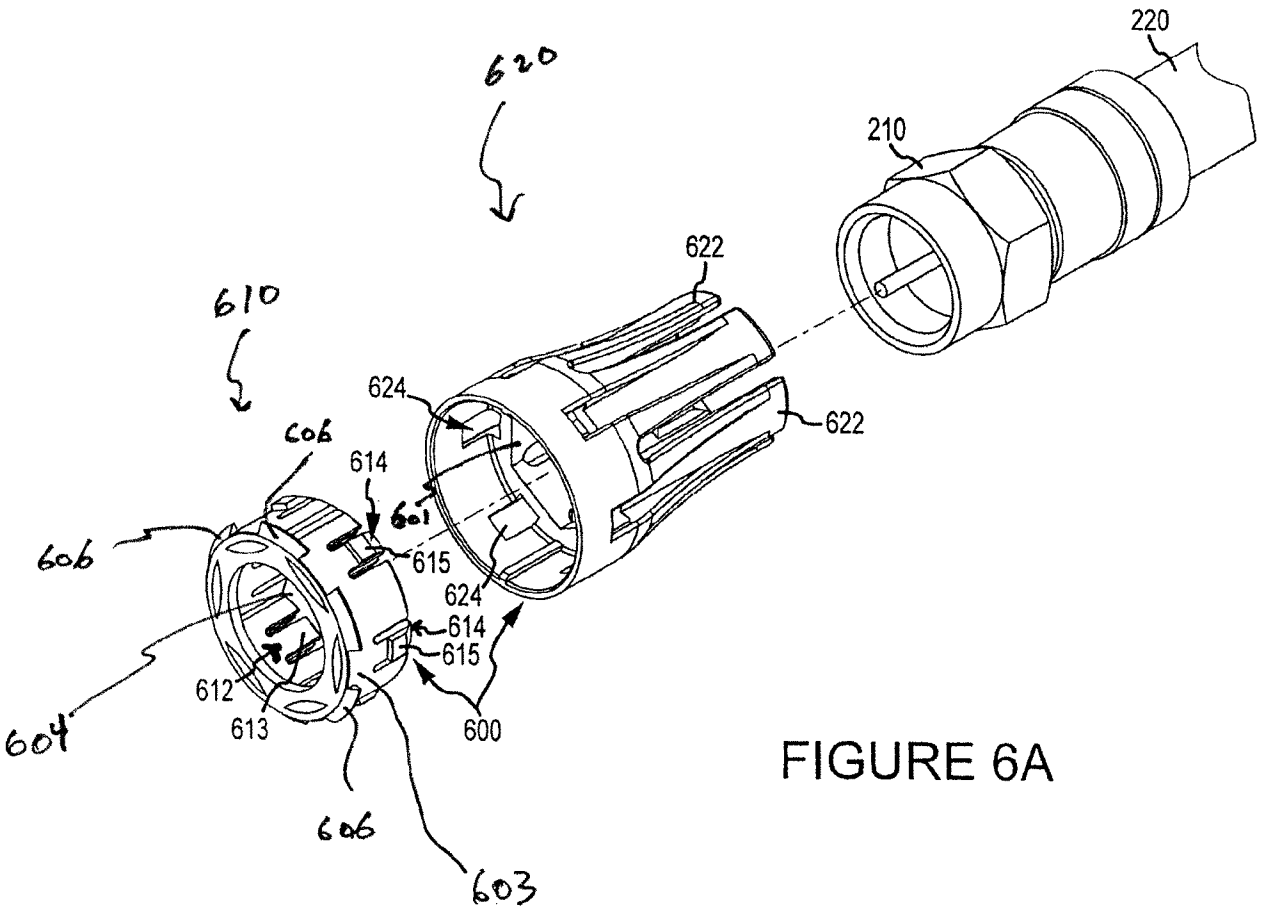
FIGS. 6A and 6*b* depict another exemplary torque application device according to various aspects of the present invention.
Figure 6B:
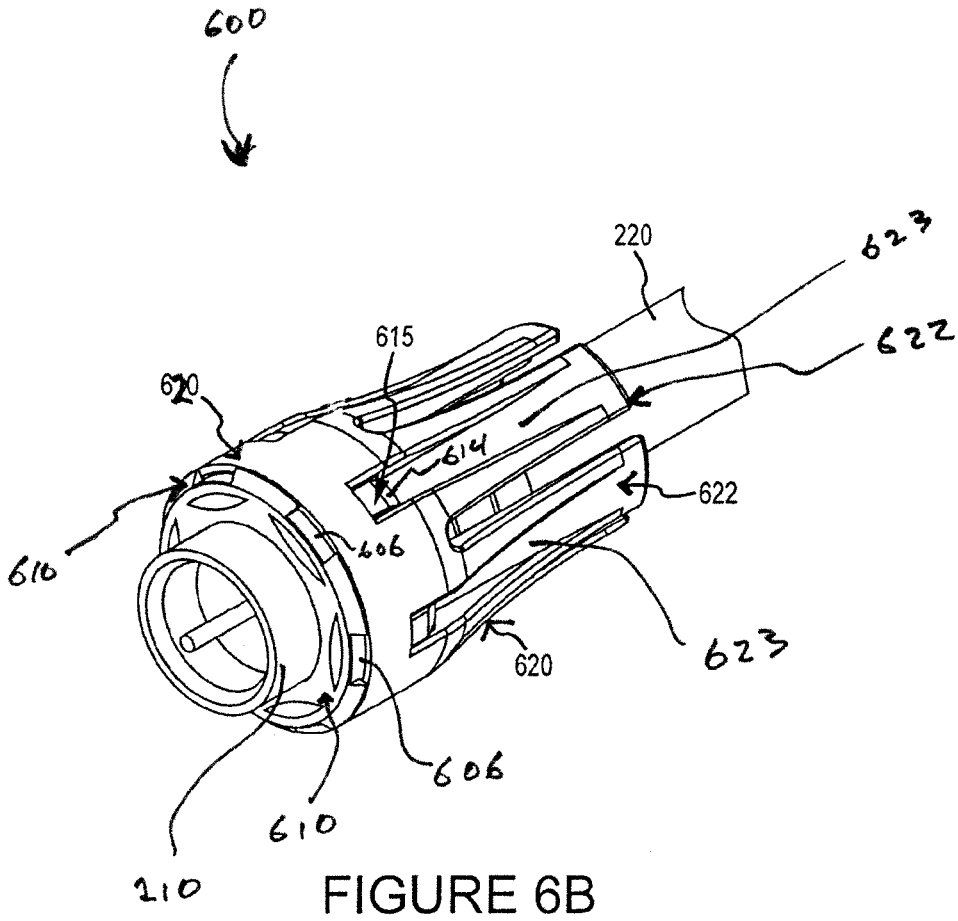

Another device according to the present invention is depicted in FIGS. 6A and 6B. In this exemplary embodiment, device 600 includes a collar 610 and a grip 620, with respective openings 604 and 601 that define a passage through the device 600 to allow for a cable 220, attached to an F-type connector fastener 210, to pass through the device 600, while the fastener 210 is retained in collar 610.

Collar 610 comprises an inner portion 612 that includes a plurality of compressible fingers 613. Fingers 613 compress around a fastener, such as the fastener 210, retaining it within collar 610. Collar 610 also comprises a plurality of fingers 614 with bases 615 (the combined fingers 614 and bases 615 are referred to herein as "protrusions"), flanges 613 and a collapsible membrane (not shown), wherein the membrane flexes when sufficient torque is applied so that fingers 614 and bases 615 disengage from retaining structures 624. The fingers 614 and bases 615 may be of any size, shape, and configuration suitable to engage retaining structures 624 on the grip 620. The protrusions may be formed on, or extend from, any suitable portion of the collar 610, and may or may not include fingers or bases, as long as they have a suitable structure for engaging a retaining structure.

Collar 610 has a front end 601, a second end 602, a body 603 and an internal cavity 604. Internal cavity 604 is designed to receive a fastener and in this preferred embodiment, inner walls 612 include extensions 613 that receive a fastener, such as hexagonal nut fastener 210. Flanges 606 properly position collar 610 and grip 620 when the two are connected, so as to not allow collar 610 to be pushed too far inside of grip 620, as can be seen, for example, in FIG. 6B.

As with the other devices described herein, the grip 620 may be configured to receive torque from any suitable source, may be formed from any suitable material(s), and may be of any suitable size, shape and configuration. In the exemplary embodiment depicted in FIGS. 6A and 6B, grip 620 includes a plurality of struts 622 arranged about its central axis and formed from semi-rigid plastic to allow a human hand or fingers to squeeze and twist the grip 620 and deliver torque to the device 600 without excessively deforming the grip 620. As shown, each finger 622 has a channel 623 to provide a better gripping surface for a user. As shown, each of the fingers 622 tapers inwards, although they may flair outward (as do the fingers in FIG. 1A) or be straight.

Grip 620 includes a plurality of retaining structures 624, each retaining structure 624 configured to engage a respective one of the plurality of the protrusions. In this exemplary embodiment, the retaining structures are apertures in the grip 620. In alternate embodiments of the invention, however, the retaining structure may include any other suitable structure(s) (such as a groove) capable of engaging a protrusion on the collar in order to couple the collar to the grip as the fastener is tightened, and allow the protrusion to disengage if a user attempts to apply more than the predetermined maximum torque to the collar.

As shown in this preferred embodiment, each protrusion is positioned on the collar 610, with each protrusion interfacing with a respective one of a plurality of retaining structures 624 formed in the grip 620. In alternate embodiments, the slip mechanism may include protrusions on the grip, with each protrusion interfacing with a respective one of a plurality of retaining structures formed in the collar.

As previously described, on device 600, each retaining structure 624 is configured to engage a protrusion when a torque of less than or equal to a predetermined maximum amount of torque is applied to the collar 610 by the grip 622. In the preferred embodiment, the protrusions disengage from the retaining structures 624 due to the flexing or compression of a flexible membrane. As torque is applied to the collar 610 via the grip 620, the collapsible membrane supporting fingers 614 and bases 615 are compressed until the protrusions disengage from, and traverse past, the retaining structures 624 if a user attempts to apply more than the predetermined maximum torque. The structure of the collapsible membrane is best depicted in FIG. 8A-4, except that for device 600 and device 700 (described below) the loosening portion and tightening portion of the collapsible membrane has relatively the same thickness, so the predetermined maximum amount of torque that can be applied in either the tightening direction or loosening direction before the protrusions disengage from the retaining structures is about the same.

If the protrusions traverse past the retaining structures 624, they preferably produce an audible indication that the maximum torque has been reached (e.g., a clicking sound). The traversal of the protrusions past the retaining structures 624 also preferably produces a tactile indication that the predetermined maximum torque has been reached.

Figure 7:
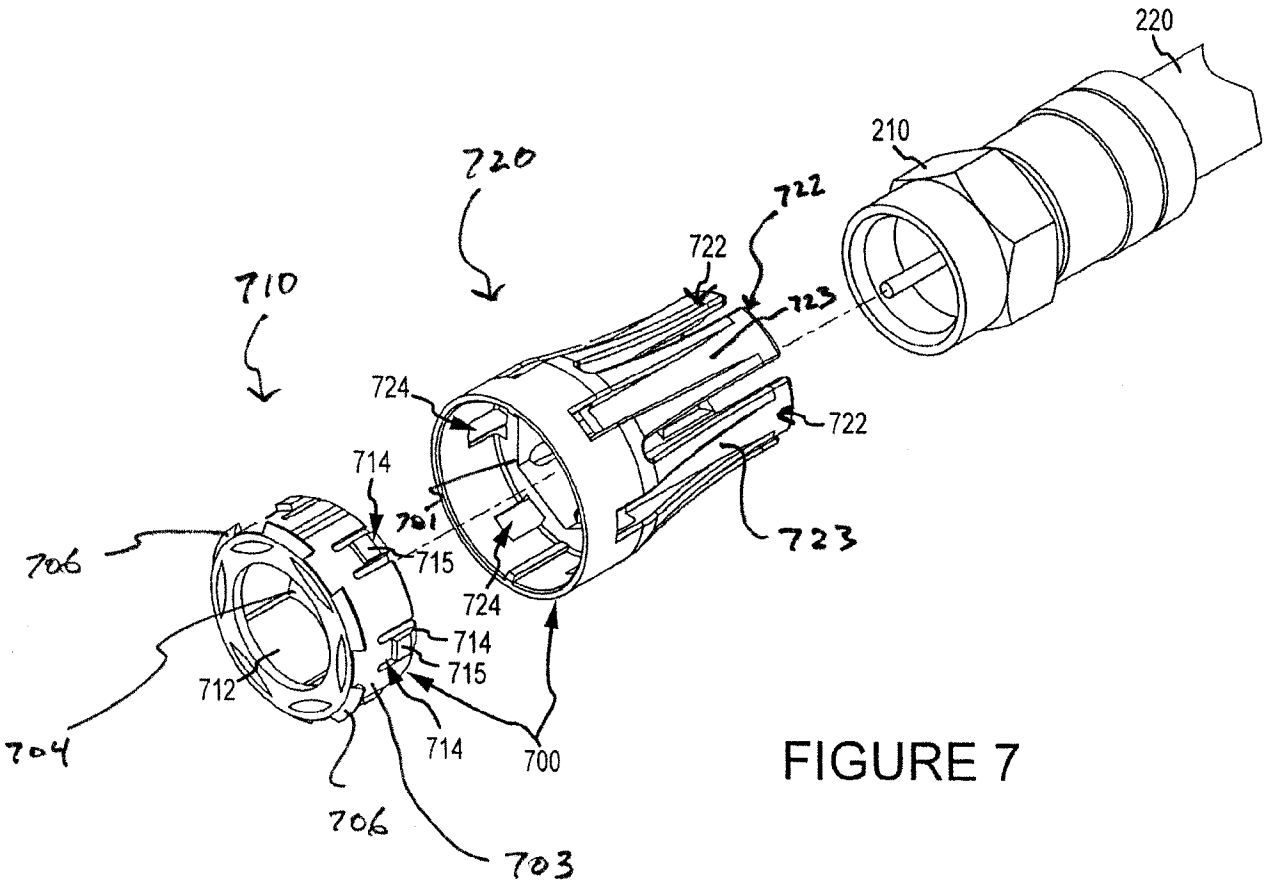
FIG. 7 depicts another exemplary torque application device according to various aspects of the present invention.

Another device according to the present invention is depicted in FIG. 7. In this exemplary embodiment, device 700 includes a collar 710 and a grip 720. Collar 710 includes a hexagonal inner portion 712 comprised of walls instead of fingers and the walls are configured to engage a corresponding hexagonal nut 210 of an F-type connector. Device 700 is in all other respects identical to the device 600 described above.

Figure 8A:
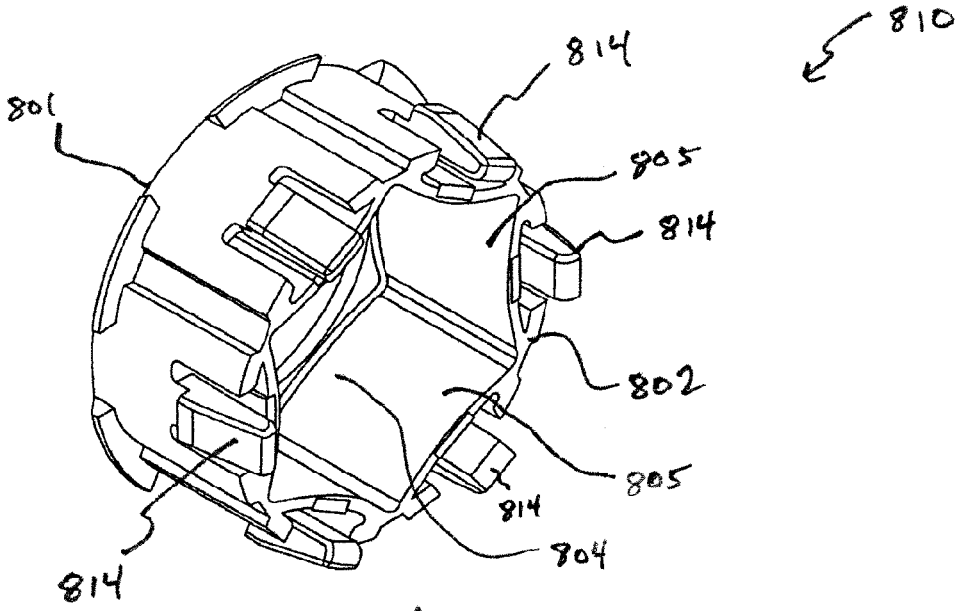
FIG. 8A is a perspective view of a collar according to another aspect of the invention.
Figures 1, 8A:
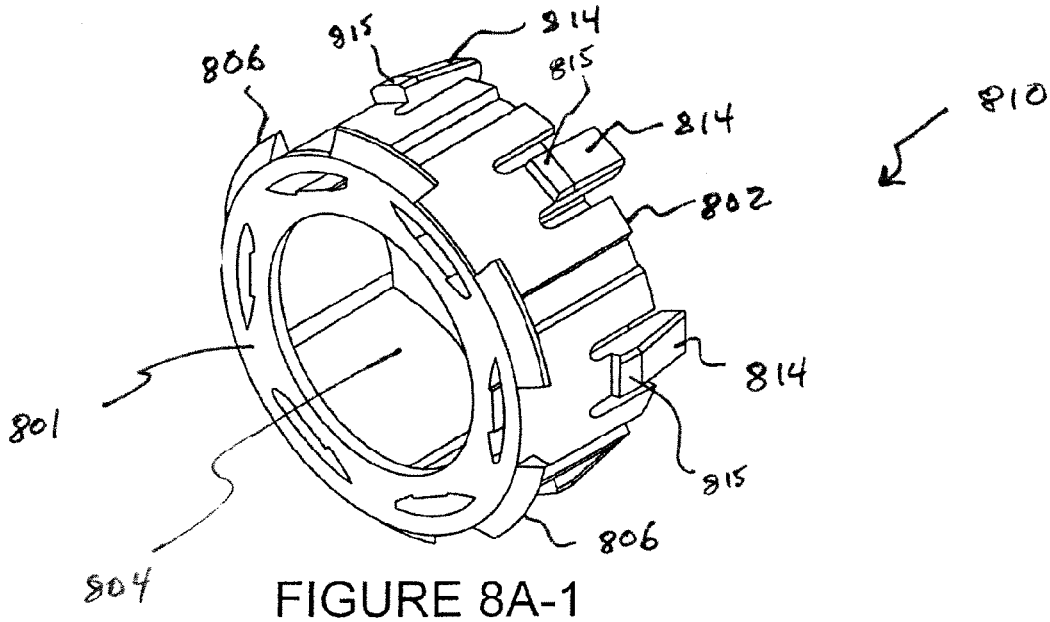
Figures 2, 8A:
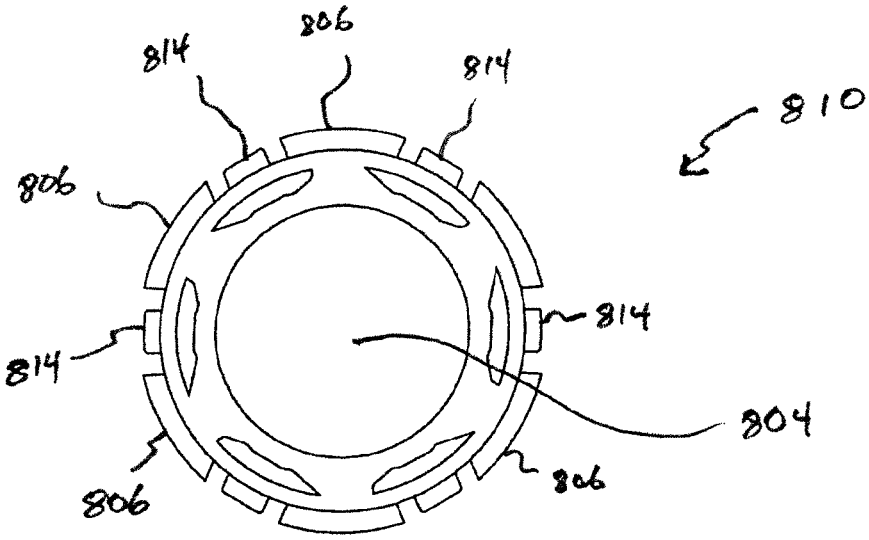
Figures 3, 8A:
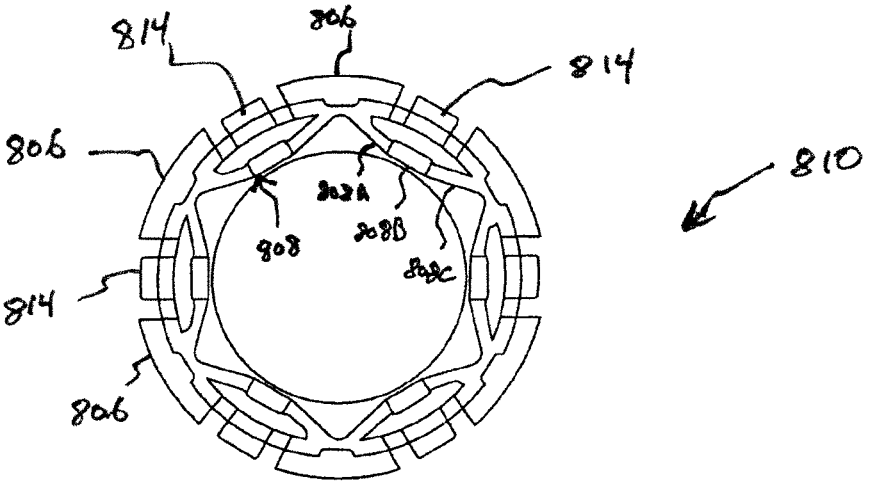
Figures 4, 8A:
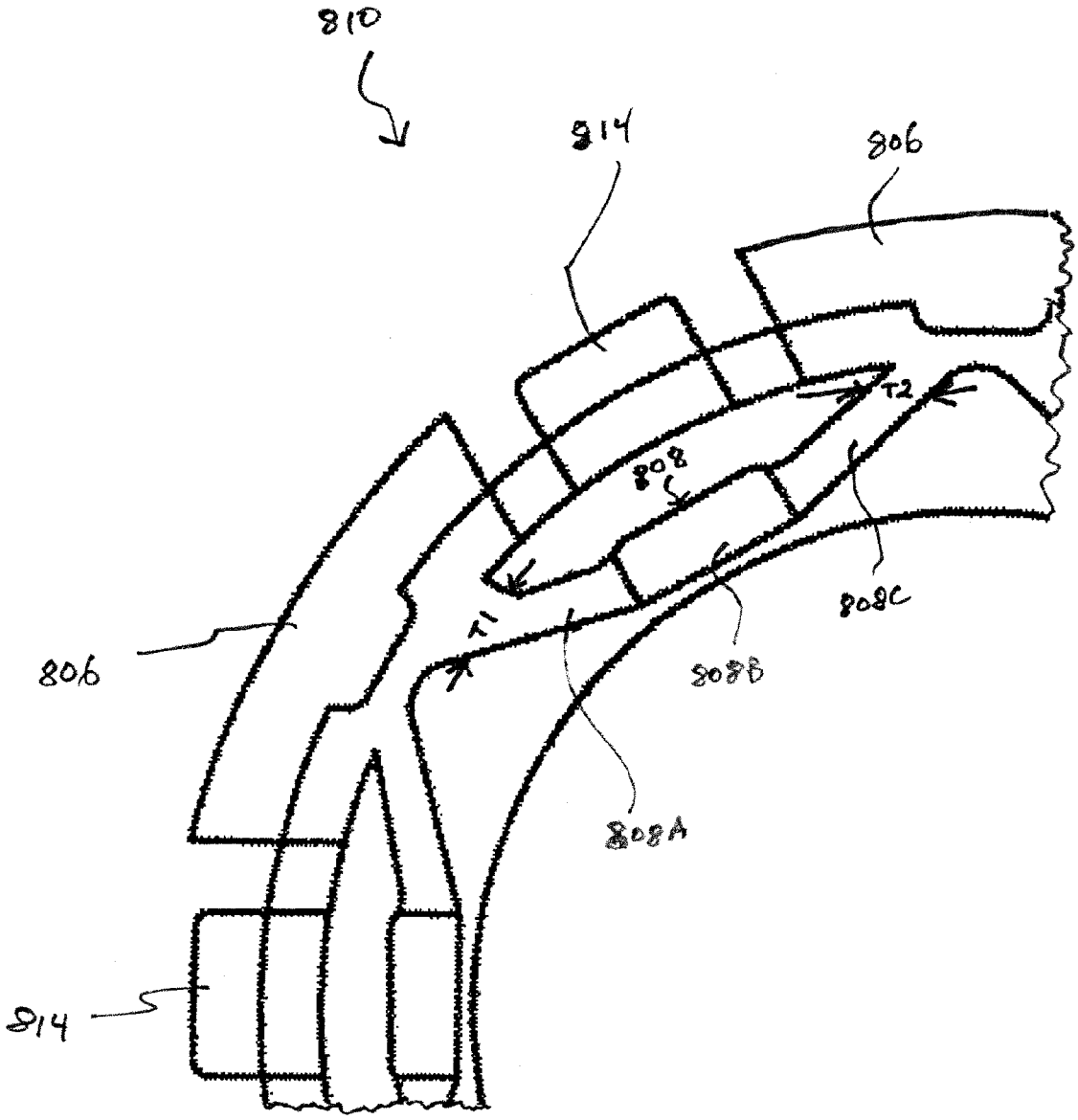
Figure 8B:
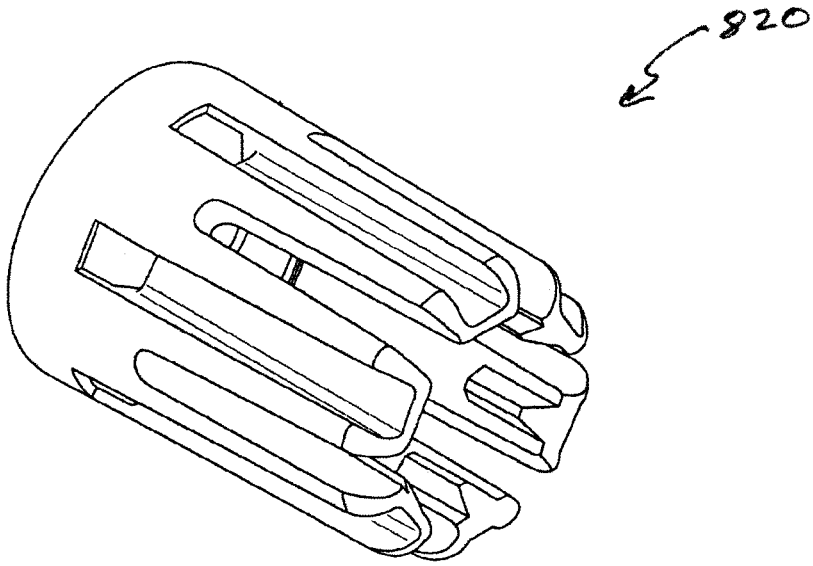
FIG. 8B is a perspective, side view of a grip that can be used with the collar of FIG. 8A.
Figures 1, 8B:
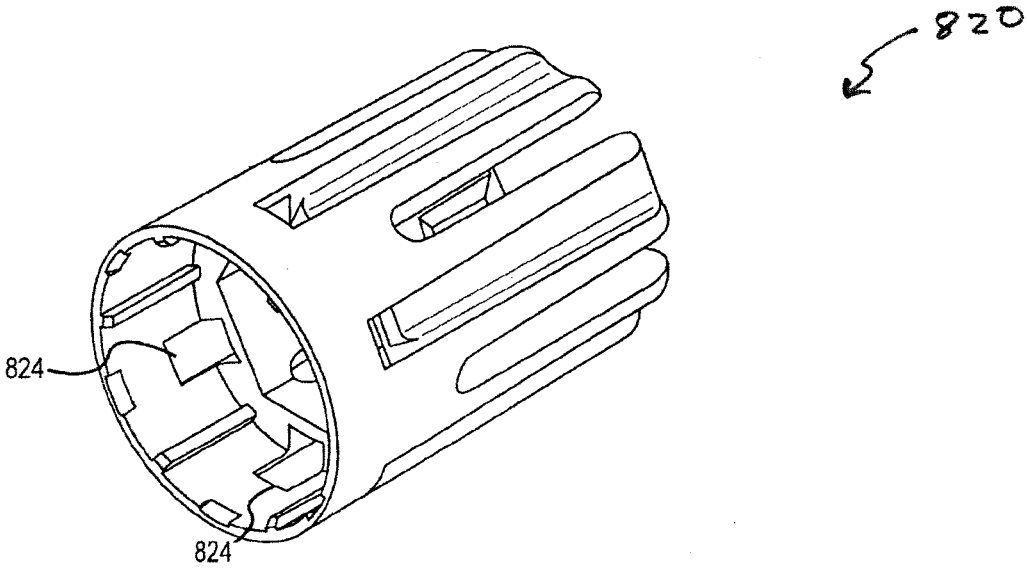
Figures 5, 8B:
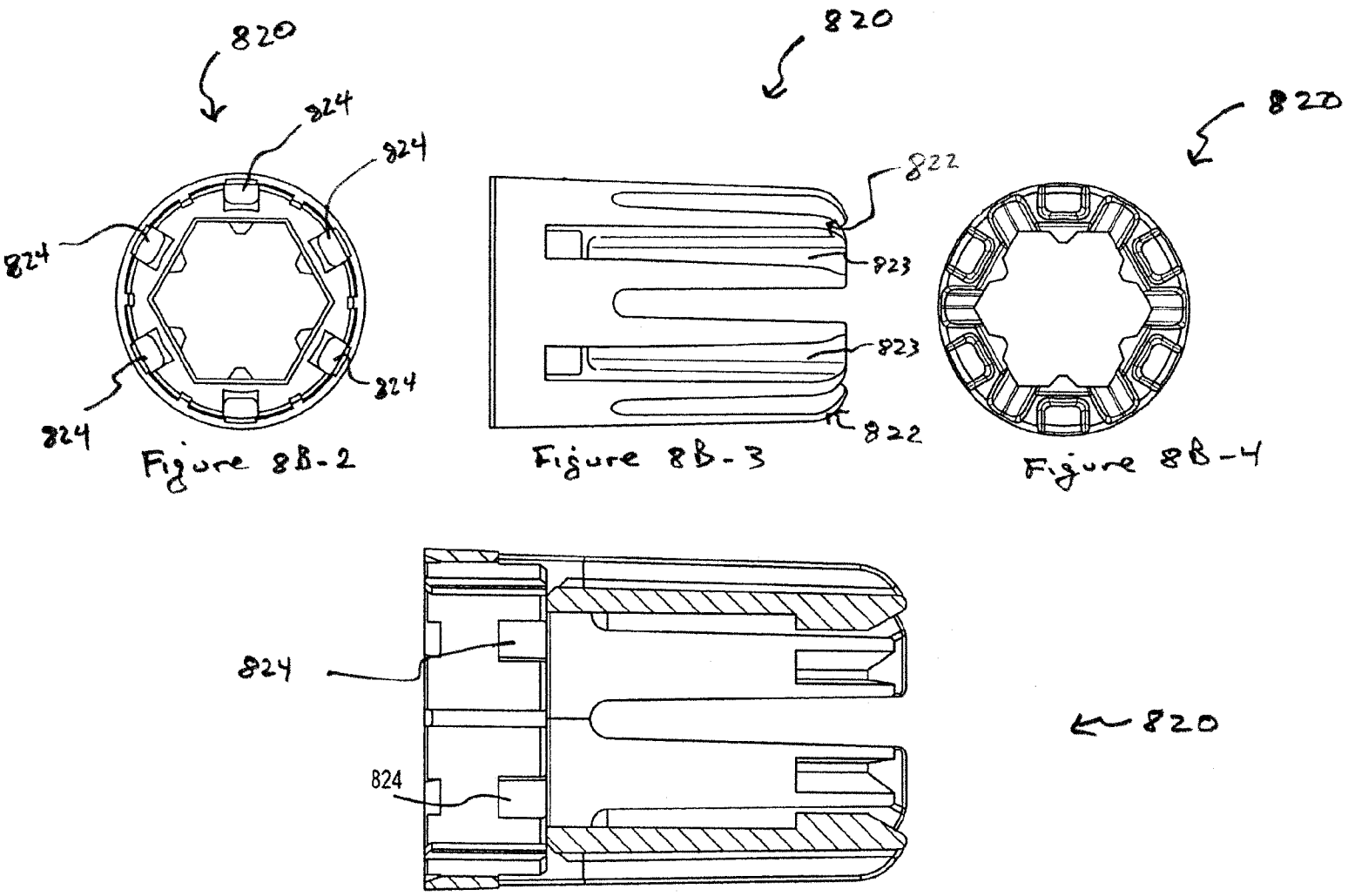
Figure 8D:
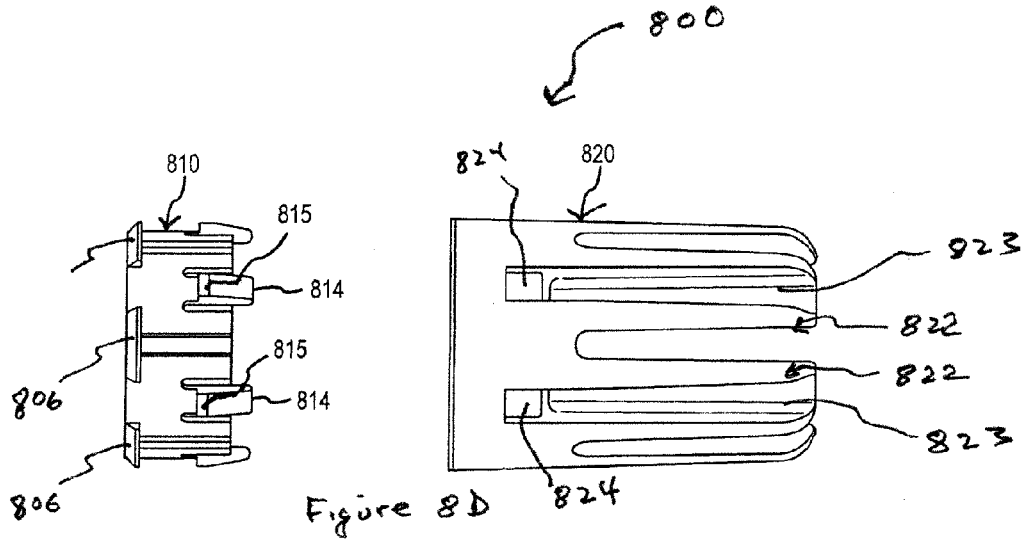
FIG. 8D is a side view of the torque application device of FIG. 8C before the collar 810 and grip 820 are connected.
Figures 1, 8D:
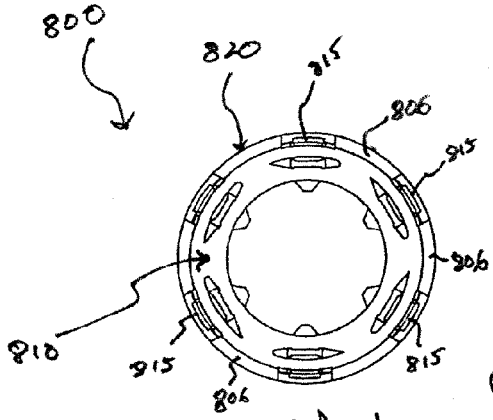
Figures 2, 8D:
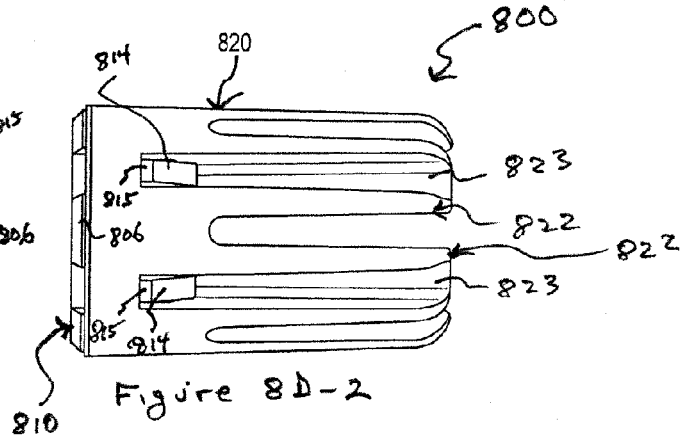

FIGS. 8A-8D2 depict another torque application device 800 according to various aspects of the present invention. Device 800 includes a collar 810 and grip 820. FIGS. 8A-8A-3 illustrate collar 810, FIG. 8B-8B-5 illustrate grip 820 and FIGS. 8C-8D-2 depict the collar 810 and grip 820 together, both unconnected and connected. In this exemplary embodiment, device 800 is configured so that more torque can be applied to loosen a fastener than to tighten it. This helps a user to generate sufficient torque to loosen a fastener, but still helps prevent the fastener from being over-tightened.

Device 800 includes a slip mechanism comprising a plurality of protrusions 815 on fingers 814 (the combined fingers 814 and bases 815 are referred to herein as "protrusions") on the collar 810, with each protrusion interfacing with a respective one of a plurality of retaining structures 824 formed in the grip 820. As with other embodiments of the invention, the protrusions may be of any size, shape, and configuration suitable to engage retaining structures 824, and may or may not include fingers or bases.

In alternate embodiments, the slip mechanism may include fingers and protrusions on the grip, with each interfacing with a respective one of a plurality of retaining structures formed in the collar. In device 800, each retaining structure 824 is configured to engage a protrusion when a torque of less than or equal to a predetermined maximum amount of torque is applied to the collar 810 by the grip 820, thus allowing a fastener positioned in collar 810 to be tightened to only a predetermined maximum amount of torque.

Collar 810 has a front end 801, a second end 802, a body 803 and an internal cavity 804. Internal cavity 804 is designed to receive a fastener and in this preferred embodiment, inner walls 805 are designed to receive a hexagonal nut fastener, such as previously described fastener 210. Flanges 806 properly position collar 810 and grip 820 when they are connected, so as to not allow collar 810 to be pushed too far inside of grip 820, as can be seen, for example, in FIG. 8C-1.

As best seen in FIG. 8A-3, body 803 has internal structural walls 808, each of which has a loosening portion 808A, a center portion 808B and a tightening portion 808C. Internal walls 808 deflect (or flex) when a predetermined maximum torque is exceeded and when walls 808 deflect sufficiently, the fingers 814 and protrusions 815 will move out of the retaining structures 824.

As best seen in FIG. 8A-4, the thickness T1 of the material at the edge of loosening portion 808A is greater than the thickness T2 at the edge of tightening portion 808C (in this embodiment and in all of the preferred embodiments depicted in this specification, tightening torque is applied in the clockwise direction and loosening torque is applied in the counterclockwise direction). Consequently, collar 810 has more structural strength in the loosening direction and can transmit more torque in that direction before wall 808A deflects and fingers 814 and protrusions 815 can slip out of retaining structures 824. In contrast, collar 810 has less structural strength in the tightening direction and less torque is required to deflect wall 808C. Consequently, more torque is required for fingers 814 and protrusions 815 to slip out of retaining structures 824 when being loosened, which makes it possible for a user to generate more torque to loosen a fastener.

Achieving the goal of generating more torque in one direction than the other could be achieved by other structures as well. For example, the shape of the fingers/protrusions and/or retaining structures could be configured such that the fingers/protrusions slip out of the retaining structures at one predetermined torque when tightening and slip out of the retaining structures at a different predetermined torque when loosening. This could be accomplished, for example, by angling the walls of the retaining structures and/or the walls of the protrusions and/or fingers, or varying the height of the walls on each side of each retaining structure, wherein less torque would be required to cause a finger and protrusion to slip past the lower of the two walls.

When the maximum level of torque is exceeded while loosening or tightening the fastener, the protrusions 815 disengage from, and traverse past, the retaining structures 824, decoupling the grip 820 from the collar 810 and preferably producing an audible indication (e.g., a clicking sound) as well as preferably a tactile indicator that the predetermined maximum amount of torque has been reached.

The protrusions 815 may be formed on, or extend from, any suitable portion of the collar 810. The retaining structure 824 on grip 820 may include any suitable structure(s) (such as a groove) capable of engaging a protrusion in order to couple the collar to the grip as a fastener is tightened, and allow the protrusion to disengage when the user attempts to apply more than the maximum predetermined torque.

As with the other devices described herein, the grip 820 may be configured to receive torque from any suitable source, may be formed from any suitable material(s), and may be of any suitable size, shape and configuration. In the exemplary embodiment depicted in FIGS. 8A and 8B, grip 820 includes a plurality of struts 822 arranged about its central axis and is formed from semi-rigid plastic to allow a human hand or fingers to squeeze and twist the grip 820 and deliver torque to the device 800 without excessively deforming the grip 820. As shown, each strut 822 has a channel 823 to provide a better gripping surface for a user. As shown, each of the struts 822 tapers inwards, although they may flair outward (as do the fingers in FIG. 1A) or be straight.

Devices of the present invention can be configured to apply any desired maximum torque to a fastener in accordance with their size, material composition and the initial source of source of the torque (e.g., human fingers or a tool), and may allow different amounts of torque to be applied in one direction than another (e.g., allow more torque to be applied when loosening than to tighten a fastener). For example, any suitable torque that can be applied by hand tightening (using the grip) could be applied, such as any torque between 5 and 25 ft-lbs. Devices providing differing maximum torques can be color-coded, or designated in any other suitable manner, to allow a user to quickly identify which device to use when installing a particular fastener.

The particular implementations shown and described above are illustrative of the invention and its best mode and are not intended to limit the scope of the invention in any way. Methods illustrated in the various figures may include more, fewer, or other steps, and steps may be performed in any suitable order. Changes and modifications may be made to the disclosed embodiments without departing from the scope of the present invention, as expressed in the appended claims.

We claim:

1. A torque application device comprising:
- a collar for engaging a fastener;
- a grip coupled to the collar, the grip including a ring and a plurality of longitudinally-extending fingers extending from the ring, wherein the grip is configured to receive torque applied via the fingers; and
- a slip mechanism comprising:
  - a plurality of protrusions; and
  - a plurality of retaining structures, wherein each retaining structure is configured to engage a protrusion when a torque less than or equal to a predetermined maximum amount of torque is applied to the collar, and whereby the protrusions disengage from the retaining structures to decouple the grip from the collar when a user attempts to tighten the fastener beyond the predetermined maximum torque.

2. The device of claim 1, wherein each finger has a longitudinal channel formed therein.

3. The device of claim 1, wherein each of the fingers flairs outward.

4. The device of claim 1, wherein each of the fingers tapers inward.

5. A torque application device comprising:
- a collar for engaging a fastener;
- a grip coupled to the collar, wherein the grip includes a ring from which a plurality of fingers extends, the ring having an inner surface; and
- a slip mechanism comprising:
  - a plurality of protrusions; and
  - a plurality of retaining structures positioned on the inner surface of the ring, wherein each retaining structure is configured to engage a protrusion when a torque less than or equal to a predetermined maximum amount of torque is applied to the collar, and whereby the protrusions disengage from the retaining structures to decouple the grip from the collar when a user attempts to tighten the fastener beyond the predetermined maximum torque.

6. The torque application device of claim 5, wherein the grip is configured to magnify torque applied to it and to transfer all or part of the magnified torque to the collar.

7. The torque application device of claim 5, wherein each of the plurality of protrusions extends from the collar.

8. The device of claim 5, wherein the collar has an outer surface and the protrusions are on the outer surface.

9. The device of claim 8, wherein the grip has a ring with an inner surface, the retaining structures being formed on the inner surface, and the outer wall of the collar configured to fit inside the ring, where the protrusions are received in the retaining structures.

10. The device of claim 5, wherein the grip has a length and the collar has a length and the length of the grip is twice or more of the length of the collar.

11. The device of claim 5, wherein when the protrusions traverse over the retaining structures an audible indication is produced.

12. The device of claim 5, wherein the collar comprises an opening for receiving the fastener and the grip comprises an opening in communication with the opening in the collar, wherein the openings in the collar and the grip define a passage, the passage configured to allow a cable to extend through the torque application device.

13. The device of claim 5, wherein the grip is configured to receive torque applied by a tool.

14. The device of claim 5, wherein the grip is comprised of plastic.

15. The device of claim 5, wherein each retaining structure is an aperture in the grip.

16. The device of claim 5, wherein the collar is configured to releasably engage the fastener.

17. The device of claim 5, wherein the collar is comprised of plastic.

18. The device of claim 5, wherein the collar comprises an opening for receiving the fastener.

19. The device of claim 18, wherein the collar comprises sections that include raised segments, the fastener being retained behind the raised segments when the fastener is retained in the opening.

20. The device of claim 19, wherein the fastener comprises one or more of the group consisting of:
- a nut;
- a bolt;
- a screw;
- a clasp; and
- a clamp.

21. The device of claim 5 that further includes a fastener positioned in the collar.

22. The device of claim 21 that further includes (a) an opening in the collar for receiving the fastener and the grip comprises an opening in communication with the opening in the collar, wherein the openings in the collar and the grip define a passage, the passage configured to allow a cable to extend through the torque application device, and (b) a cable connected to the fastener, the cable extending through the passage.

23. A torque application device comprising:
- a collar for engaging a fastener, the collar including six longitudinally-extending fingers;
- a grip coupled to the collar; and
- a slip mechanism comprising:
  - a plurality of protrusions; and
  - a plurality of retaining structures, wherein each retaining structure is configured to engage a protrusion when a torque less than or equal to a predetermined maximum amount of torque is applied to the collar, and whereby the protrusions disengage from the retaining structures to decouple the grip from the collar when a user attempts to tighten the fastener beyond the predetermined maximum torque.

24. A torque application device comprising:
- a collar for engaging a fastener, wherein the collar has flanges;
- a grip coupled to the collar, wherein the grip has a ring portion and an end juxtaposed the ring portion, the flanges being pressed against the end when the grip is positioned on the collar; and a slip mechanism comprising:

a plurality of protrusions; and a plurality of retaining structures, wherein each retaining structure is configured to engage a protrusion when a torque less than or equal to a predetermined maximum amount of torque is applied to the collar, and whereby the protrusions disengage from the retaining structures to decouple the grip from the collar when a user attempts to tighten the fastener beyond the predetermined maximum torque.

25. A torque application device comprising:

a collar for engaging a fastener, wherein the collar comprises an opening for receiving the fastener and an inner portion including a plurality of compressible segments for retaining the fastener;

a grip coupled to the collar; and a slip mechanism comprising:

a plurality of protrusions; and a plurality of retaining structures, wherein each retaining structure is configured to engage a protrusion when a torque less than or equal to a predetermined maximum amount of torque is applied to the collar, and whereby the protrusions disengage from the retaining structures to decouple the grip from the collar when a user attempts to tighten the fastener beyond the predetermined maximum torque.

26. The device of claim 25, wherein when the protrusions traverse over the retaining structures a tactile indication is produced.

27. The device of claim 25, wherein the grip is configured to receive torque applied by a human hand.

28. The device of claim 25, wherein more torque can be applied in the loosening direction than the tightening direction.

29. A torque application device comprising:

a collar for engaging a fastener, wherein the collar includes an inner support wall;

a grip coupled to the collar; and a slip mechanism comprising:

a plurality of protrusions; and a plurality of retaining structures, wherein each retaining structure is configured to engage a protrusion when a torque less than or equal to a predetermined maximum amount of torque is applied to the collar, and whereby the protrusions disengage from the retaining structures to decouple the grip from the collar when a user attempts to tighten the fastener beyond the predetermined maximum torque, and wherein the inner support wall flexes to permit the protrusions to disengage from the retaining structures if a user applies more than the predetermined maximum amount of torque.

30. The device of claim 29, wherein each protrusion has an inner support wall.

31. The device of claim 30, wherein each support wall has a tightening segment and a loosening segment, the tightening segment having a thickness and the loosening segment having a thickness, the thickness of the loosening segment being greater than the thickness of the tightening segment so that more torque can be applied to loosen the fastener than to tighten the fastener.

* * * * *